US008374856B2

(12) United States Patent
Kim et al.

(10) Patent No.: US 8,374,856 B2
(45) Date of Patent: Feb. 12, 2013

(54) METHOD AND APPARATUS FOR CONCEALING PACKET LOSS, AND APPARATUS FOR TRANSMITTING AND RECEIVING SPEECH SIGNAL

(75) Inventors: Hong Kook Kim, Gwangju (KR); Choong Sang Cho, Gwangju (KR)

(73) Assignee: Intellectual Discovery Co., Ltd., Seoul (KR)

( * ) Notice: Subject to any disclaimer, the term of this patent is extended or adjusted under 35 U.S.C. 154(b) by 1071 days.

(21) Appl. No.: 12/351,096

(22) Filed: Jan. 9, 2009

(65) Prior Publication Data

US 2009/0240490 A1 Sep. 24, 2009

(30) Foreign Application Priority Data

Mar. 20, 2008 (KR) ..... 10-2008-0025686

(51) Int. Cl.
*G10L 19/00* (2006.01)
*G10L 21/00* (2006.01)

(52) U.S. Cl. ..... 704/228; 704/219; 704/207; 704/201; 375/240.27

(58) Field of Classification Search ..... 704/219, 704/201, 207, 228; 375/240.27
See application file for complete search history.

(56) References Cited

U.S. PATENT DOCUMENTS 6,549,587 B1 * 4/2003 Li ..... 375/326
6,636,829 B1 * 10/2003 Benyassine et al. ..... 704/201
6,757,654 B1 * 6/2004 Westerlund et al. ..... 704/262
6,810,377 B1 * 10/2004 Ho et al. ..... 704/208
7,324,937 B2 * 1/2008 Thyssen et al. ..... 704/219
7,457,746 B2 * 11/2008 Gao ..... 704/219
7,552,048 B2 * 6/2009 Xu et al. ..... 704/206
7,565,286 B2 * 7/2009 Gracie et al. ..... 704/217
7,587,315 B2 * 9/2009 Unno ..... 704/223
7,693,710 B2 * 4/2010 Jelinek et al. ..... 704/207
7,877,253 B2 * 1/2011 Krishnan et al. ..... 704/225
7,957,961 B2 * 6/2011 Zhan et al. ..... 704/219
7,979,272 B2 * 7/2011 Kang et al. ..... 704/219
8,219,393 B2 * 7/2012 Oh et al. ..... 704/224
8,255,207 B2 * 8/2012 Vaillancourt et al. ..... 704/219

* cited by examiner

*Primary Examiner* — Talivaldis Ivars Smits
*Assistant Examiner* — Shaun Roberts
(74) *Attorney, Agent, or Firm* — NSIP Law

(57) ABSTRACT

A method and apparatus for concealing frame loss and an apparatus for transmitting and receiving a speech signal that are capable of reducing speech quality degradation caused by packet loss are provided. In the method, when loss of a current received frame occurs, a random excitation signal having the highest correlation with a periodic excitation signal (i.e., a pitch excitation signal) decoded from a previous frame received without loss is used as a noise excitation signal to recover an excitation signal of a current lost frame. Furthermore, a third, new attenuation constant (AS) is obtained by summing a first attenuation constant (NS) obtained based on the number of continuously lost frames and a second attenuation constant (PS) predicted in consideration of change in amplitude of previously received frames to adjust the amplitude of the recovered excitation signal for the current lost frame. Speech quality degradation caused by packet loss can be reduced for enhanced communication quality in a packet network environment with continuous frame loss.

29 Claims, 18 Drawing Sheets

Periodic excitation

Random excitation

Noise excitation

FIG. 15

| | Loss rate of 3% | | | Loss rate of 5% | | |
|---|---|---|---|---|---|---|
| Number of continuously lost frames | G729 method | Conventional method | Inventive method | G729 method | Conventional method | Inventive method |
| 1 | 3.40 | 3.40 | 3.41 | 3.25 | 3.25 | 3.27 |
| 2 | 3.31 | 3.33 | 3.38 | 3.12 | 3.15 | 3.21 |
| 3 | 3.26 | 3.32 | 3.36 | 3.04 | 3.10 | 3.16 |
| 4 | 3.20 | 3.30 | 3.34 | 2.93 | 3.08 | 3.13 |
| 5 | 3.21 | 3.30 | 3.31 | 2.94 | 3.10 | 3.14 |
| 6 | 3.20 | 3.34 | 3.35 | 2.96 | 3.12 | 3.14 |

FIG. 16

| | | Preference (%) | | |
|---|---|---|---|---|
| Burstness/ frame loss rate | | G729 method | Similarity | Inventive method |
| γ = 0 | 3% | 6.0 | 75.0 | 19.0 |
| | 5% | 3.0 | 90.0 | 7.0 |
| γ = 1 | 3% | 3.0 | 39.0 | 58.0 |
| | 5% | 27.0 | 37.0 | 37.0 |
| Average | | 9.75 | 60.25 | 30.25 |

FIG. 17

| | | Preference (%) | | |
|---|---|---|---|---|
| Burstness/ frame loss rate | | G729 method | Similarity | Inventive method |
| γ = 0 | 3% | 8.33 | 44.75 | 47.92 |
| | 5% | 4.17 | 41.67 | 54.17 |
| γ = 1 | 3% | 2.08 | 54.17 | 43.75 |
| | 5% | 4.20 | 37.50 | 58.30 |
| Average | | 4.69 | 44.27 | 51.04 |

METHOD AND APPARATUS FOR CONCEALING PACKET LOSS, AND APPARATUS FOR TRANSMITTING AND RECEIVING SPEECH SIGNAL

CROSS-REFERENCE TO RELATED APPLICATION

This application claims the benefit of Korean Patent Application No. 10-2008-0025686, filed Mar. 20, 2008, the disclosure of which is hereby incorporated herein by reference in its entirety.

BACKGROUND OF THE INVENTION

1. Field of the Invention

The present invention relates to speech decoding based on a packet network, and more particularly, to a method and apparatus for concealing frame loss that are capable of reducing speech quality degradation caused by packet loss in an environment in which speech signals are transferred via a packet network, and an apparatus for transmitting and receiving a speech signal using the same.

2. Description of the Related Art

Demand for speech transmission over an Internet Protocol (IP) network, such as Voice over Internet Protocol (VoIP) or Voice over Wireless Fidelity (VoWiFi), is increasing on a wide scale. In an IP network, delay caused by jitter and packet loss caused by line overload degrade speech quality.

Packet loss concealment (PLC) methods for minimizing speech quality degradation caused by packet loss in speech transmission over an IP network include a method of concealing frame loss at a transmitting stage and a method of concealing frame loss at a receiving stage.

Representative methods for concealing frame loss at a transmitting stage include forward error correction (FEC), interleaving, and retransmission. The methods for concealing frame loss at a receiving stage include insertion, interpolation, and model-based recovery.

The methods for concealing frame loss at a transmitting stage require additional information to conceal frame loss when it occurs and an additional transfer bits for transferring the additional information. However, these methods have the advantage of preventing sudden degradation of speech quality even at a high frame loss rate.

On the other hand, with the methods of concealing frame loss at a receiving stage, a transfer rate does not increase, but speech quality is suddenly degraded as the frame loss rate increases.

Extrapolation, which is a conventional method for concealing frame loss at a receiving stage, is applied to a parameter of the most recent frame recovered without loss in order to obtain a parameter for a lost frame. In a method for concealing frame loss with G.729 using extrapolation, a copy of a linear prediction coefficient of a frame recovered without loss is used for a linear prediction coefficient of a lost frame, and a reduced codebook gain of a frame recovered without loss is used as a codebook gain of a lost frame. Further, an excitation signal for a lost frame is recovered using an adaptive codebook and an adaptive codebook gain based on a pitch value for a frame decoded without loss, or using a randomly selected pulse location and sign of a fixed codebook and a fixed codebook gain. However, the conventional technique of concealing packet loss using extrapolation exhibits low performance in predicting parameters for a lost frame and has a limited ability to conceal the frame loss.

In the conventional methods for concealing frame loss using interpolation and extrapolation at a receiving stage, parameters for frames recovered without loss immediately preceding and immediately following a lost frame are linearly interpolated to recover a current lost parameter and conceal the loss, which causes a time delay until normal frames are received following the lost frame. Further, when continuous frame loss occurs, the loss increases an interval between the frames located at either side of the lost frame and received correctly without loss, which degrades recovery performance and increases the delay.

Among the conventional methods for concealing frame loss at a receiving stage, a technique for generating an excitation signal using random combination includes randomly arranging a previous excitation signal in order to generate an excitation signal having the same function as a fixed codebook for a Code-Excited Linear Prediction (CELP) CODEC. Conventional research showed that the fixed codebook, which is an excitation signal generating element for the CELP CODEC, has a random characteristic and is affected by a periodic component. The conventional method for generating an excitation signal using random combination cannot correctly generate a noise excitation signal (serving as the fixed codebook) because it considers only the random characteristic.

Meanwhile, among the conventional methods for concealing frame loss at a receiving stage, methods for adjusting the amplitude of a recovered signal include decreasing the amplitude of the recovered signal and applying an increment from a signal before loss when continuous frame loss occurs. In these methods, change in a speech signal is not properly considered in producing the recovered signal, which degrades speech quality.

SUMMARY OF THE INVENTION

The present invention is directed to a method for concealing frame loss that enhances accuracy in recovering a lost frame of a speech signal transmitted via a packet network, thereby reducing speech quality degradation caused by packet loss and providing improved speech quality.

The present invention is also directed to an apparatus for concealing frame loss that enhances accuracy in recovering a lost frame of a speech signal transmitted via a packet network, thereby reducing speech quality degradation caused by packet loss and providing improved speech quality.

The present invention is also directed to a speech transmitting and receiving apparatus having the apparatus for concealing frame loss.

According to an embodiment of the present invention, a method for concealing frame loss in a speech decoder includes: when loss of a current received frame occurs, calculating a voicing probability using an excitation signal and a pitch value decoded from a previous frame received without loss; generating a noise excitation signal using a random excitation signal and a pitch excitation signal generated from the excitation signal decoded from the previous frame received without loss; and applying a weight determined by the voicing probability to the pitch excitation signal and the noise excitation signal to recover an excitation signal for the current lost frame. A correlation between the random excitation signal and the pitch excitation signal may be obtained and a random excitation signal having the highest correlation with the pitch excitation signal may be used as the noise excitation signal. The previous frame received without loss may include the most recently received lossless frame. Calculating a voicing probability may include: calculating a first correlation coefficient of the excitation signal decoded from the previous frame received without loss, based on the pitch value, from the excitation signal and the pitch value decoded from the previous frame received without loss; calculating a voicing factor using the first calculated correlation coefficient; and calculating the voicing probability using the calculated voicing factor. The random excitation signal may be generated by randomly permuting the excitation signal decoded from the previous frame received without loss, and the pitch excitation signal may be a periodic excitation signal generated through repetition of the pitch decoded from the previous frame received without loss. Applying a weight determined by the voicing probability to the pitch excitation signal and the noise excitation signal to recover an excitation signal for the current lost frame may include: applying the voicing probability as a weight to the pitch excitation signal, applying a non-voicing probability determined by the voicing probability as a weight to the noise excitation signal, and summing the resultant signals to recover the excitation signal for the current lost frame. The method may further include: reducing a linear prediction coefficient of the previous frame received without loss to recover a linear prediction coefficient for the current lost frame. The method may further include: multiplying a first attenuation constant (NS) obtained based on the number of continuously lost frames by a first weight, multiplying a second attenuation constant (PS) predicted in consideration of change in amplitude of previously received frames by a second weight, and multiplying a third attenuation constant (AS) calculated by summing the first attenuation constant (NS) multiplied by the first weight and the second attenuation constant (PS) multiplied by the second weight, by the recovered excitation signal for the current lost frame, to adjust the amplitude of the recovered excitation signal for the current lost frame. The second attenuation constant (PS) may be obtained by applying linear regression analysis to an average of the excitation signals for the previously received frames. The method may further include: applying the amplitude-adjusted recovered excitation signal and the recovered linear prediction coefficient for the current lost frame to a synthesis filter to recover and output speech for the current lost frame. The method may further include: multiplying the recovered excitation signal for the current lost frame by the first attenuation constant (NS) obtained based on the number of continuously lost frames to adjust the amplitude of the recovered excitation signal for the current lost frame. The method may further include: when loss of the current received frame does not occur, decoding the current frame to recover the excitation signal and linear prediction coefficient. When continuous frame loss occurs, a voicing probability calculated using the pitch value and the excitation signal decoded from the most recent frame received without loss may be used as a voicing probability for recovering an excitation signal for a second lost frame.

According to another exemplary embodiment of the present invention, a method for concealing frame loss in a speech decoder includes: when loss of a current received frame occurs, calculating a voicing probability using an excitation signal and a pitch value decoded from a previous frame received without loss; generating a random excitation signal and a pitch excitation signal from the excitation signal decoded from the previous frame received without loss; applying a weight determined by the voicing probability to the pitch excitation signal and the random excitation signal to recover an excitation signal for the current lost frame; and adjusting the amplitude of the recovered excitation signal for the current lost frame using a third attenuation constant calculated based on a first attenuation constant obtained based on the number of continuously lost frames and a second attenuation constant predicted in consideration of change in amplitude of previously received frames. Adjusting the amplitude of the recovered excitation signal for the current lost frame may include: multiplying the first attenuation constant obtained based on the number of continuously lost frames by the first weight, multiplying the second attenuation constant predicted in consideration of the change in amplitude of previously received frames with the second weight, and multiplying the recovered excitation signal for the current lost frame by the third attenuation constant calculated by summing the first attenuation constant multiplied by the first weight and the second attenuation constant multiplied by the second weight to adjust the amplitude of the recovered excitation signal for the current lost frame. The second attenuation constant may be obtained by applying linear regression analysis to an average of the excitation signals for previously received frames. Calculating a voicing probability may include: calculating a first correlation coefficient of the excitation signal decoded from the previous frame received without loss, based on the pitch value, from the excitation signal and the pitch value decoded from the previous frame received without loss; calculating a voicing factor using the first calculated correlation coefficient; and calculating the voicing probability using the calculated voicing factor. Applying a weight determined by the voicing probability to the pitch excitation signal and the random excitation signal to recover an excitation signal for the current lost frame may include: applying the voicing probability as a weight to the pitch excitation signal, applying a non-voicing probability determined by the voicing probability as a weight to the noise excitation signal, and summing the resultant signals to recover the excitation signal for the current lost frame.

According to still another exemplary embodiment of the present invention, a program for performing the methods for concealing frame loss is provided.

According to yet another exemplary embodiment of the present invention, a computer-readable recording medium having a program stored thereon for performing the methods for concealing frame loss is provided.

According to yet another exemplary embodiment of the present invention, an apparatus for concealing frame loss in a received speech signal includes: a frame loss concealing unit for: when loss of a current received frame occurs, calculating a voicing probability using an excitation signal and a pitch value decoded from a previous frame received without loss, generating a noise excitation signal using a random excitation signal and a pitch excitation signal generated from the excitation signal decoded from the previous frame received without loss, and applying a weight determined with the voicing probability to the pitch excitation signal and the noise excitation signal to recover an excitation signal for the current lost frame. The apparatus may further include a frame loss determiner for determining whether loss of the current received frame occurs. A correlation between the random excitation signal and the pitch excitation signal may be obtained and a random excitation signal having the highest correlation with the pitch excitation signal may be used as the noise excitation signal. The frame loss concealing unit may apply the voicing probability as a weight to the pitch excitation signal, apply a non-voicing probability determined by the voicing probability as a weight to the noise excitation signal, and sum the resultant signals to recover the excitation signal for the current lost frame. The frame loss concealing unit may further include a linear prediction coefficient recovering unit for reducing a linear prediction coefficient of the previous frame received without loss and recovering a linear prediction coefficient for the current lost frame. The frame loss concealing unit may multiply a first attenuation constant (NS) obtained based on the number of continuously lost frames by the first weight, multiply a second attenuation constant (PS) predicted in consideration of the change in amplitude of previously received frames by the second weight, and multiply the recovered excitation signal for the current lost frame by a third attenuation constant (AS) calculated by summing the first attenuation constant multiplied by the first weight NS and the second attenuation constant multiplied by the second weight PS to adjust the amplitude of the recovered excitation signal for the current lost frame.

According to yet another exemplary embodiment of the present invention, an apparatus for concealing frame loss in a received speech signal includes: a frame loss concealing unit for: when loss of a current received frame occurs, calculating a voicing probability using an excitation signal and a pitch value decoded from a previous frame received without loss, generating a noise excitation signal using a random excitation signal and a pitch excitation signal generated from the excitation signal decoded from the previous frame received without loss, and applying a weight determined by the voicing probability to the pitch excitation signal and the noise excitation signal to recover an excitation signal for the current lost frame.

According to yet another exemplary embodiment of the present invention, an apparatus for transmitting and receiving a speech signal via a packet network includes: an analog-digital converter for converting an input analog speech signal into a digital speech signal; a speech encoder for compressing and encoding the digital speech signal; a packet protocol module for converting the compressed and encoded digital speech signal according to Internet protocol to produce a speech packet, unpacking a speech packet received from the packet network, and converting the speech packet into speech data on a frame-by-frame basis; a speech decoder for recovering the speech signal from the speech data on a frame-by-frame basis; and a digital-analog converter for converting the recovered speech signal into an analog speech signal, wherein the speech decoder comprises: a frame backup unit for storing an excitation signal and a pitch value decoded from a previous frame received without loss; and a frame loss concealing unit for: when loss of a current received frame occurs, calculating a voicing probability using the excitation signal and the pitch value decoded from the previous frame received without loss, generating a noise excitation signal using a random excitation signal and a pitch excitation signal produced from the excitation signal decoded from the previous frame received without loss, and applying a weight determined by the voicing probability to the pitch excitation signal and the noise excitation signal to recover an excitation signal for the current lost frame. The frame loss concealing unit may obtain a correlation between the random excitation signal and the pitch excitation signal and use a random excitation signal having the highest correlation with the pitch excitation signal as the noise excitation signal.

BRIEF DESCRIPTION OF THE DRAWINGS

These and/or other objects, aspects and advantages of the invention will become apparent and more readily appreciated from the following description of the exemplary embodiments, taken in conjunction with the accompanying drawings of which:

FIG. 15 is a table showing PESQ measurement results for 2, 3, 4, 5, and 6 continuously lost frames in order to evaluate the performance of the method for concealing frame loss shown in FIG. 4 when continuous frame loss occurs;

FIG. 16 is a table showing subjective evaluation results for speech quality in a conventional method for concealing continuous frame loss and a G.729 method for concealing frame loss;

FIG. 17 is a table showing subjective speech quality evaluation results in the enhanced method for concealing frame loss according to the present invention and the G.729 method for concealing frame loss.

DETAILED DESCRIPTION OF EXEMPLARY EMBODIMENTS

Figure 1:
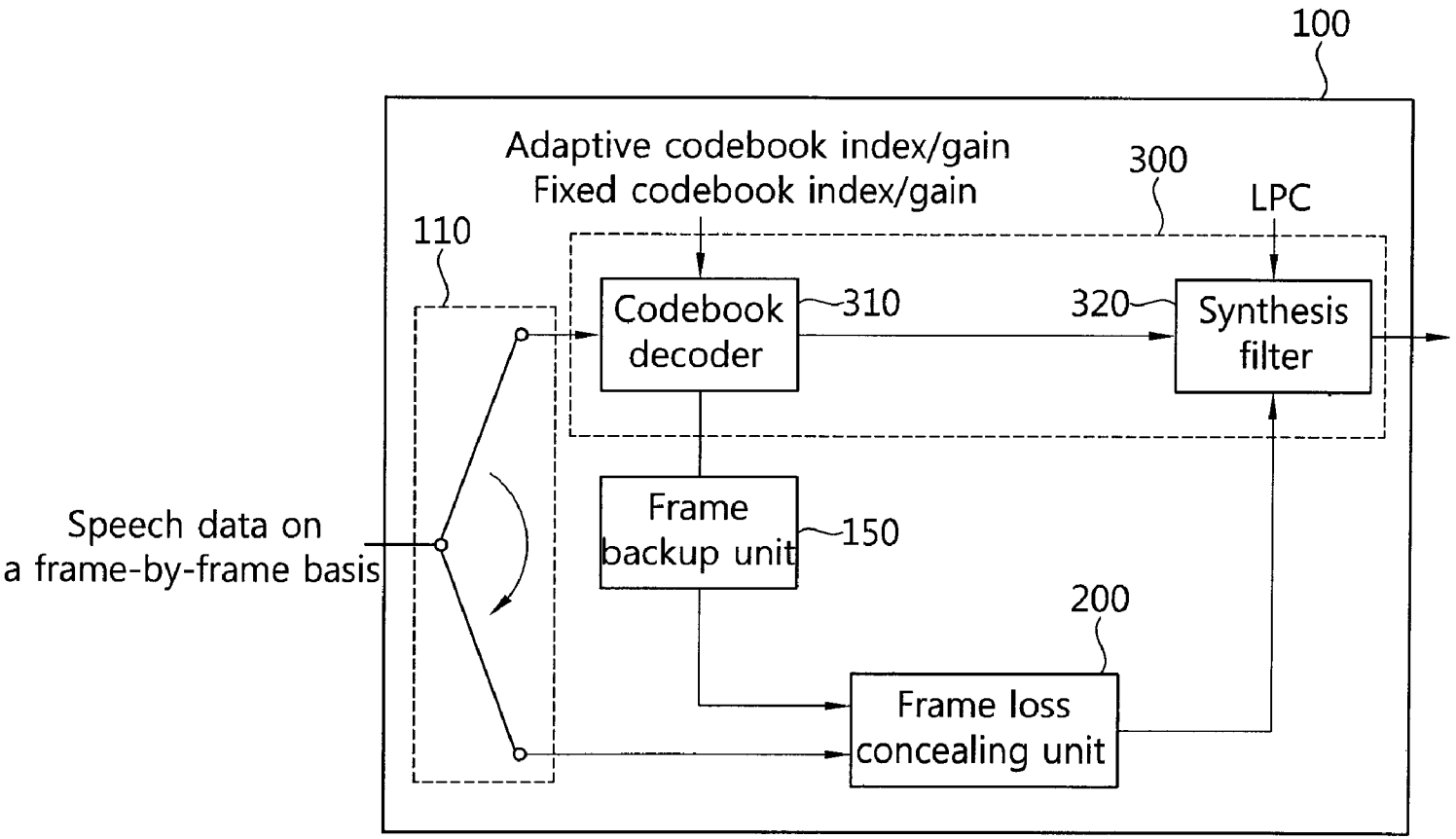
FIG. 1 is a block diagram of a speech decoder using a method for concealing packet loss according to an exemplary embodiment of the present invention.

The present invention will now be described more fully hereinafter with reference to the accompanying drawings, in which exemplary embodiments of the invention are shown. This invention may, however, be embodied in many different forms and should not be construed as limited to the exemplary embodiments set forth herein. Whenever elements appear in the drawings or are mentioned in the specification, they are always denoted by the same reference numerals.

It will be understood that, although the terms first, second, A, B, etc. may be used herein to denote various elements, these elements are not limited by these terms. These terms are only used to distinguish one element from another. For example, a first element could be termed a second element, and, similarly, a second element could be termed a first element, without departing from the scope of the exemplary embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, numbers, steps, operations, elements and/or components, but do not preclude the presence or addition of one or more other features, numbers, steps, operations, elements, components and/or groups thereof.

Unless otherwise defined, all terms (including technical and scientific terms) used herein have the same meanings as commonly understood by one of ordinary skill in the art to which this invention pertains. It will be further understood that terms defined in common dictionaries should be interpreted within the context of the relevant art and not in an idealized or overly formal sense unless expressly so defined herein.

FIG. 1 is a block diagram of a speech decoder using a method for concealing packet loss according to an exemplary embodiment of the present invention. The speech decoder 100 is a packet-loss concealing apparatus for performing the method for concealing packet loss according to an exemplary embodiment of the present invention.

The method for concealing packet loss according to the present invention will now be described with respect to a code-excited linear prediction (CELP)-based speech decoder that is widely used in VoIP. A frame receiving stage of the CELP-based speech decoder is shown in FIG. 1. A transmitting stage of the CELP-based speech decoder transmits a speech frame through three processes of Linear Prediction Coefficient (LPC) analysis, pitch search, and codebook index performed on a pulse-code modulation (PCM) signal obtained by converting a waveform of a speech signal. The packet may consist of one or multiple frames.

Referring to FIG. 1, the speech decoder 100 according to the present invention may include a frame loss determiner 110, a frame backup unit 150, a frame loss concealing unit 200, and a decoder 300. The decoder 300 may include a codebook decoder 310 and a synthesis filter 320.

The frame backup unit 150 stores information on a previous frame received correctly without loss, such as an excitation signal, a pitch value, a linear prediction coefficient, and the like. Here, the previous frame received correctly without loss is the most recent frame received correctly without loss. For example, when a current frame is the m-th frame and the (m−1)-th and (m−2)-th frames are lossless frames, the previous frame received correctly without loss may be the (m−1)-th frame, which is the most recent frame received without loss. Alternatively, the previous frame received correctly without loss may be the (m−2)-th frame. It is hereinafter assumed that the previous frame received correctly without loss is the most recently received lossless frame.

The frame loss determiner 110 determines whether loss of a frame of speech data received on a frame-by-frame basis occurs, and performs switching to either the decoder 300 or the frame loss concealing unit 200. The frame loss determiner 110 counts the number of continuously lost frames of the speech data received on a frame-by-frame basis. When frame loss does not occur, the frame loss determiner 110 may reset a numerical value of the continuously lost frames.

When frame loss occurs, the most recent frame received without loss and stored in the frame backup unit 150 may be used to recover an excitation signal for the lost frame according to an exemplary embodiment of the present invention.

When the current received frame is lossless, the decoder 300 decodes the frame. Specifically, when the current received frame is lossless, the codebook decoder 310 obtains an adaptive codebook using an adaptive codebook memory value and a pitch value of the decoded current frame and obtains a fixed codebook using a fixed codebook index and a sign of the decoded current frame. The codebook decoder 310 applies decoded adaptive and fixed codebook gains as weights to the adaptive codebook and the fixed codebook, respectively, and sums them to generate an excitation signal. A pitch filter (not shown) serves to push samples away from each other by one or more pitches to have a correlation relationship, and uses the pitch and the gain of the decoded current frame for filtering.

When the current received frame is lossless, the synthesis filter 320 performs synthesis filtering using the excitation signal produced by the codebook decoder 310 and a linear prediction coefficient (LPC) of the decoded current frame. Here, the decoded linear prediction coefficient serves as a filter coefficient of a typical FIR filter, and the decoded excitation signal is used as an input to the filter. The synthesis filtering is performed through typical FIR filtering.

When the current received frame is lost, the frame loss concealing unit 200 recovers an excitation signal and a linear prediction coefficient for the current lost frame through a frame concealment process. The frame loss concealing unit 200 recovers the excitation signal and the linear prediction coefficient of the current lost frame using the excitation signal, the pitch value and the linear prediction coefficient for the most recent frame received without loss and stored in the frame backup unit 150, and provides the excitation signal and the linear prediction coefficient to the synthesis filter 320. Operation of the frame loss concealing unit 200 will be described in detail later.

When the current received frame is lost, the synthesis filter 320 performs synthesis filtering using the excitation signal 241 and the linear prediction coefficient 251 recovered by the frame loss concealing unit 200.

When initial frame loss occurs, the excitation signal may be recovered using the most recent frame received without loss.

The present invention may be applied to continuous frame loss as well as a frame loss. That is, each time loss of the current received frame occurs, it may be counted to increment the numerical value of the continuous lost frames, and when frame loss does not occur, the numerical value of the continuous lost frames may be reset.

Figure 2:
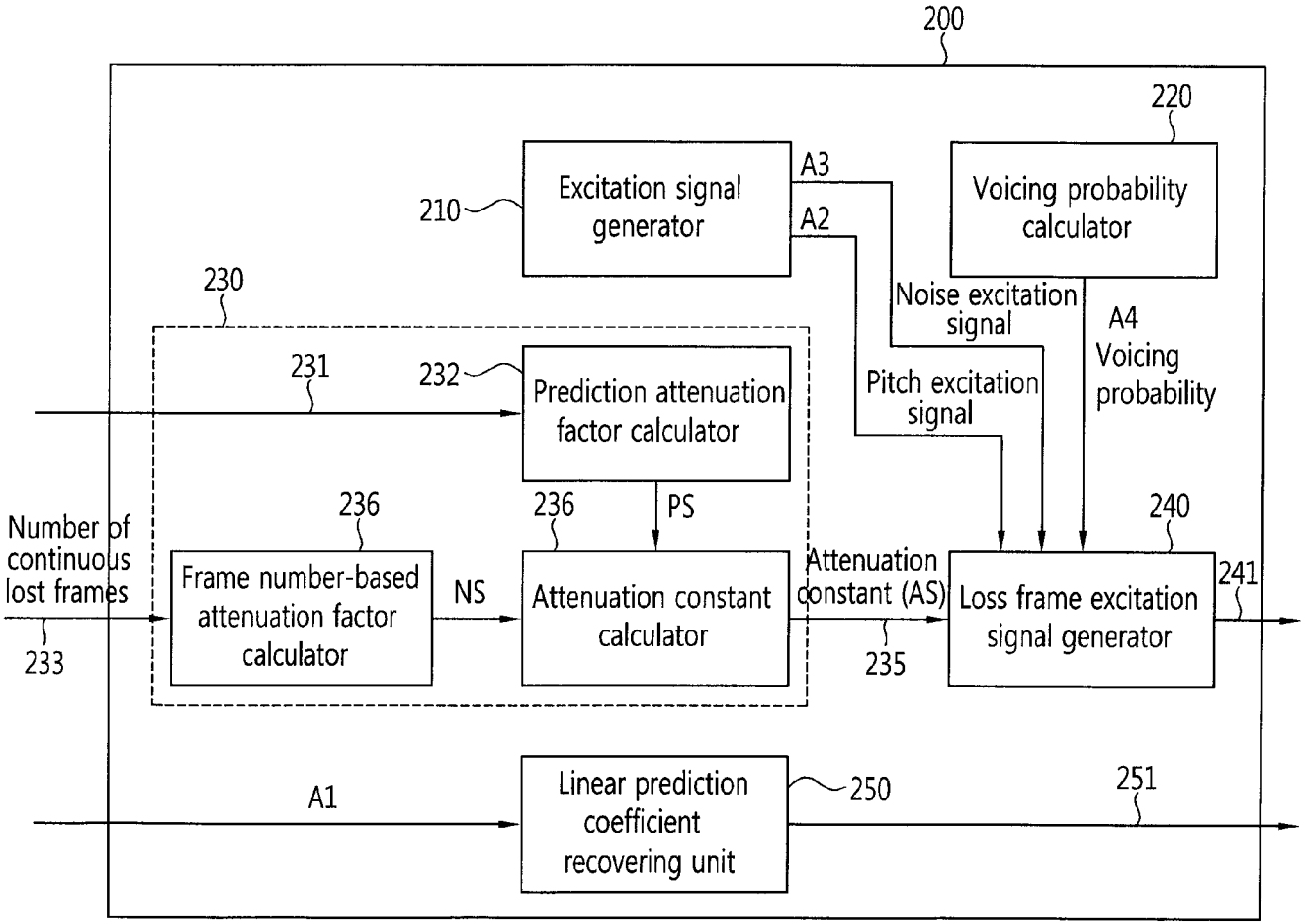
FIG. 2 is a block diagram of a frame loss concealing unit according to an exemplary embodiment of the present invention.
Figure 3:
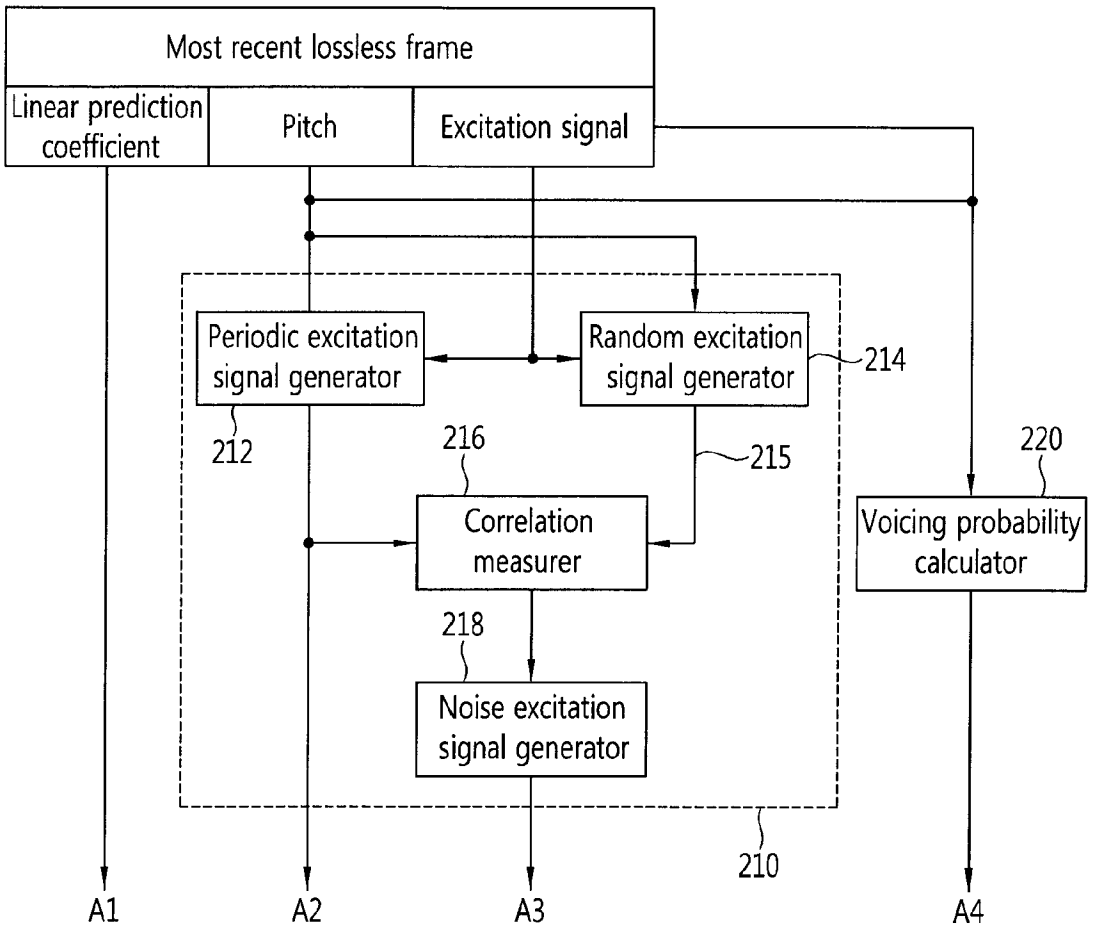
FIG. 3 is a block diagram of an excitation signal generator of FIG. 2.

FIG. 2 is a block diagram of the frame loss concealing unit according to an exemplary embodiment of the present invention, and FIG. 3 is a block diagram of an excitation signal generator of FIG. 2.

Referring to FIG. 2, the frame loss concealing unit 200 includes an excitation signal generator 210, a voicing-probability calculator 220, an attenuation constant generator 230, a lost frame excitation signal generator 240, and a linear prediction coefficient recovering unit 250.

The excitation signal generator 210 recovers the excitation signal and generates a noise excitation signal 219 using the excitation signal and the pitch value for the most recent frame received without loss and stored in the frame backup unit 150.

Specifically, referring to FIG. 3, a periodic excitation signal generator 212 repeatedly generates a periodic excitation signal (hereinafter, referred to as 'a pitch excitation signal') A2 using repetition of the pitch of the most recent frame received without loss, and the random excitation signal generator 214 randomly permutes the excitation signal for the most recent frame received without loss to generate a random excitation signal 215. A correlation measurer 216 calculates a correlation between the pitch excitation signal A2 and the random excitation signal 215. The noise excitation signal generator 218 generates a random excitation signal having the highest correlation with the pitch excitation signal A2, as a noise excitation signal A3.

The voicing-probability calculator 220 calculates a voicing probability from the excitation signal and the pitch value decoded from the (m−1)-th frame, which is the most recently received lossless frame.

The attenuation constant generator 230 may include a frame number-based attenuation factor calculator 234, a prediction attenuation factor calculator 232, and an attenuation constant calculator 236. The frame number-based attenuation factor calculator 234 obtains a first attenuation constant NS based on the number of continuously lost frames, and the prediction attenuation factor calculator 232 obtains a second attenuation constant PS that is predicted in consideration of change in amplitude of the previously received frames. The attenuation constant calculator 236 produces a third attenuation constant using the first attenuation constant NS and the second attenuation constant PS.

The lost frame excitation signal generator 240 multiplies the produced pitch excitation signal A2 by the voicing probability as a weight and the noise excitation signal A3 by a non-voicing probability as a weight, and sums the signals to generate an excitation signal for the lost frame. The lost frame excitation signal generator 240 also multiplies the excitation signal for the lost frame by the third produced attenuation constant 235, and outputs an excitation signal 241 for the amplitude-adjusted lost frame.

The linear prediction coefficient recovering unit 250 recovers the linear prediction coefficient for the lost frames using the linear prediction coefficient decoded from the most recently received lossless frame.

Figure 4:
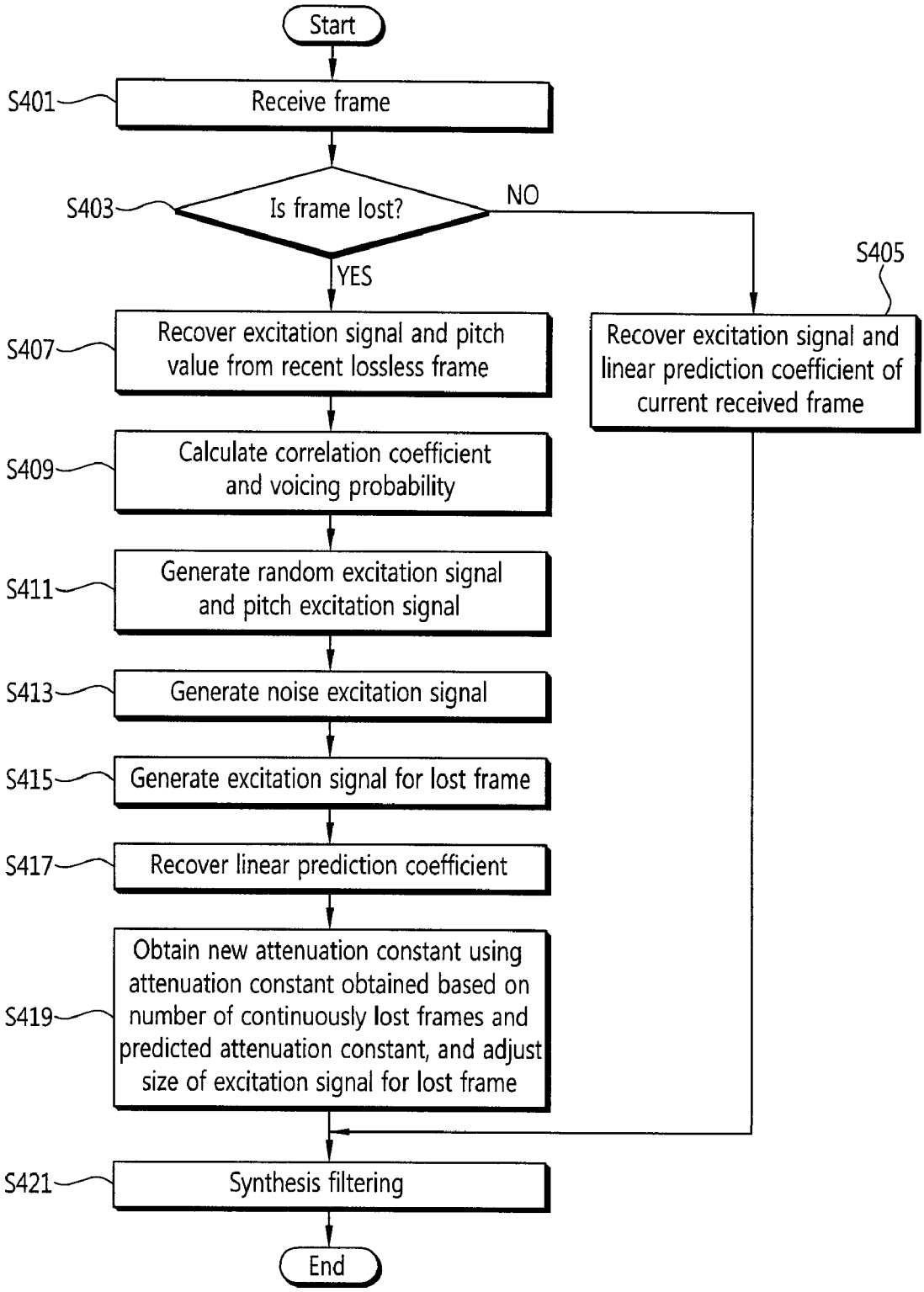
FIG. 4 is a flowchart illustrating a method for concealing frame loss according to an exemplary embodiment of the present invention.
Figure 5:
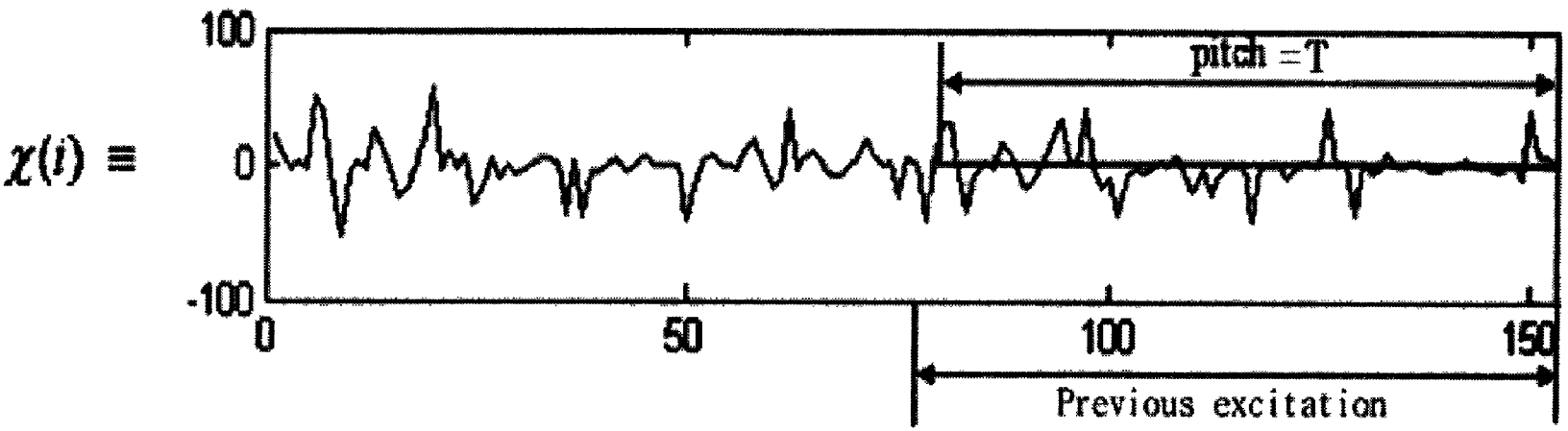
FIG. 5 is a graph showing an excitation signal and a pitch for the most recent frame recovered without loss for use in calculating a voicing factor according to an exemplary embodiment of the present invention.
Figure 6:
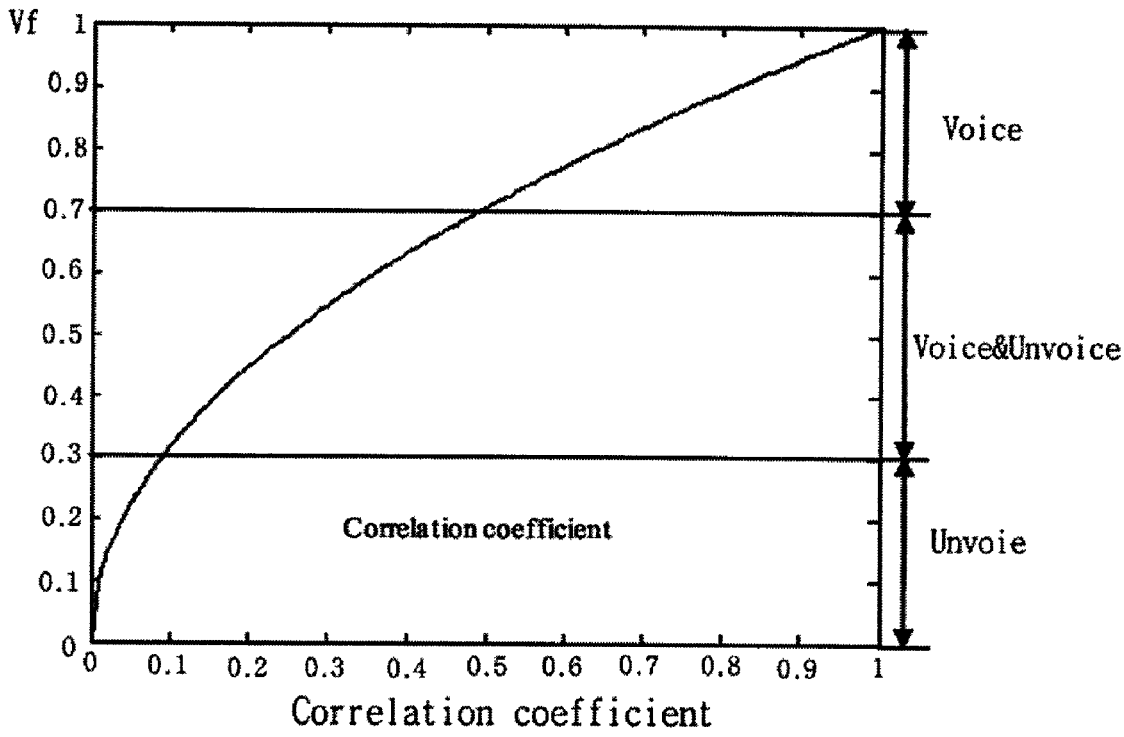
FIG. 6 is a conceptual diagram for explaining classification of signals depending on a voicing probability.
Figure 7:
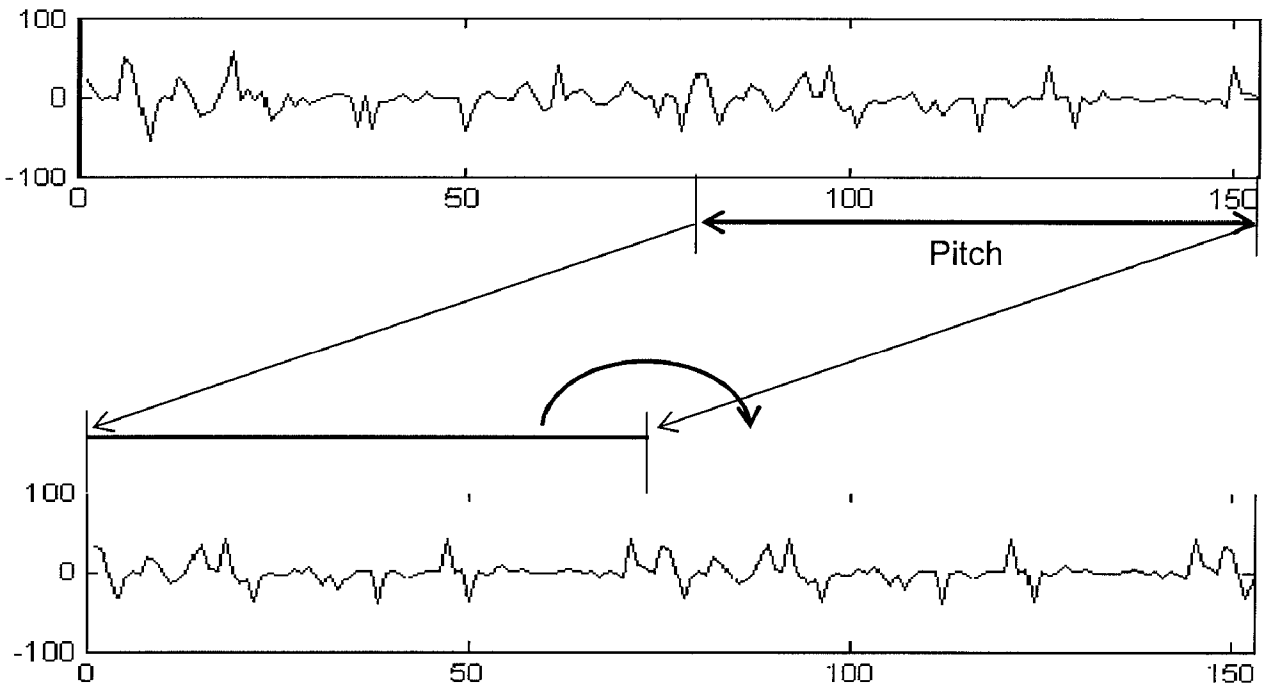
FIG. 7 is a conceptual diagram for explaining a process of generating a periodic pitch excitation signal.
Figure 8:
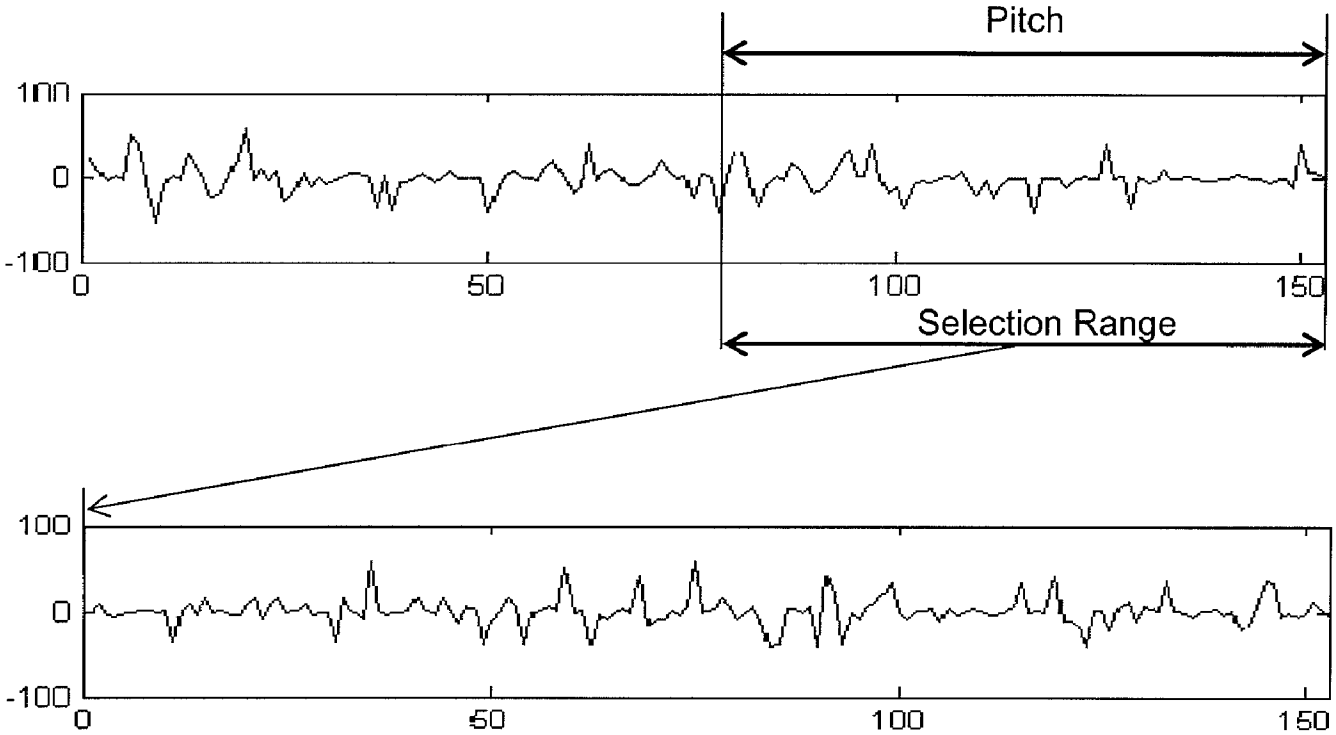
FIGS. 8 and 9 are conceptual diagrams for explaining a process of generating a random excitation signal.
Figure 9:
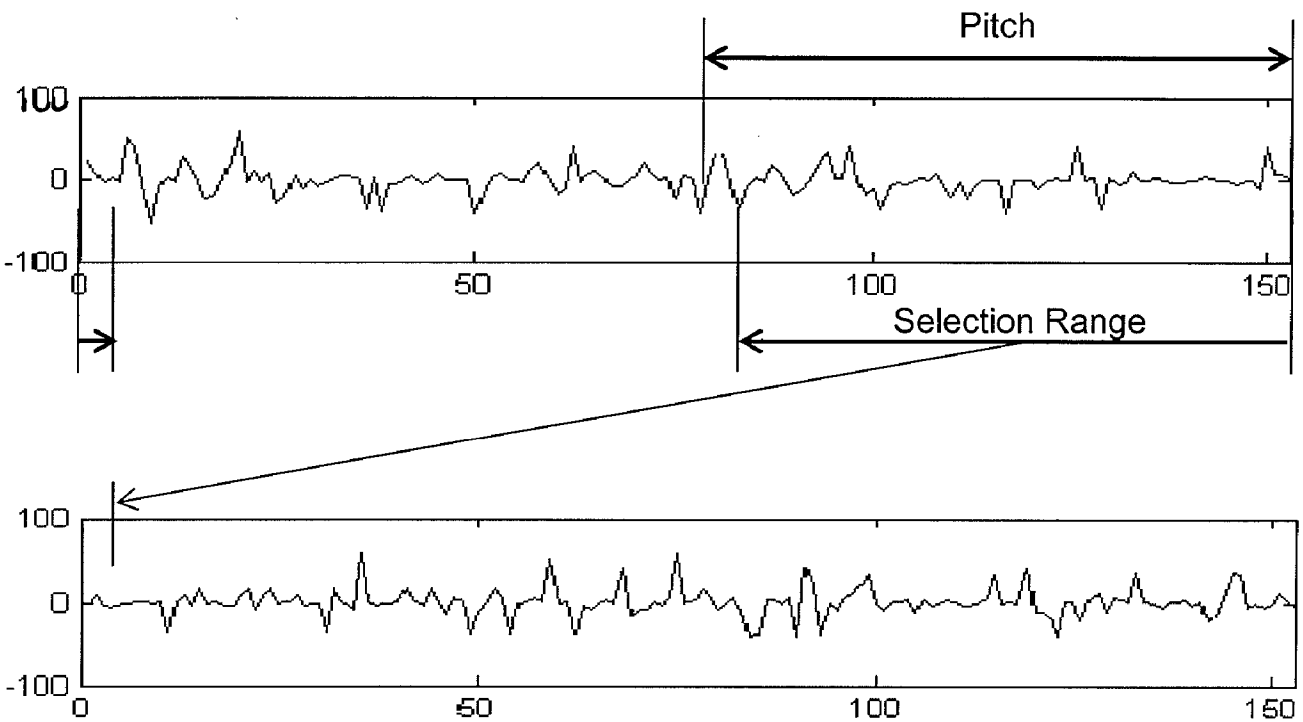
Figure 10:
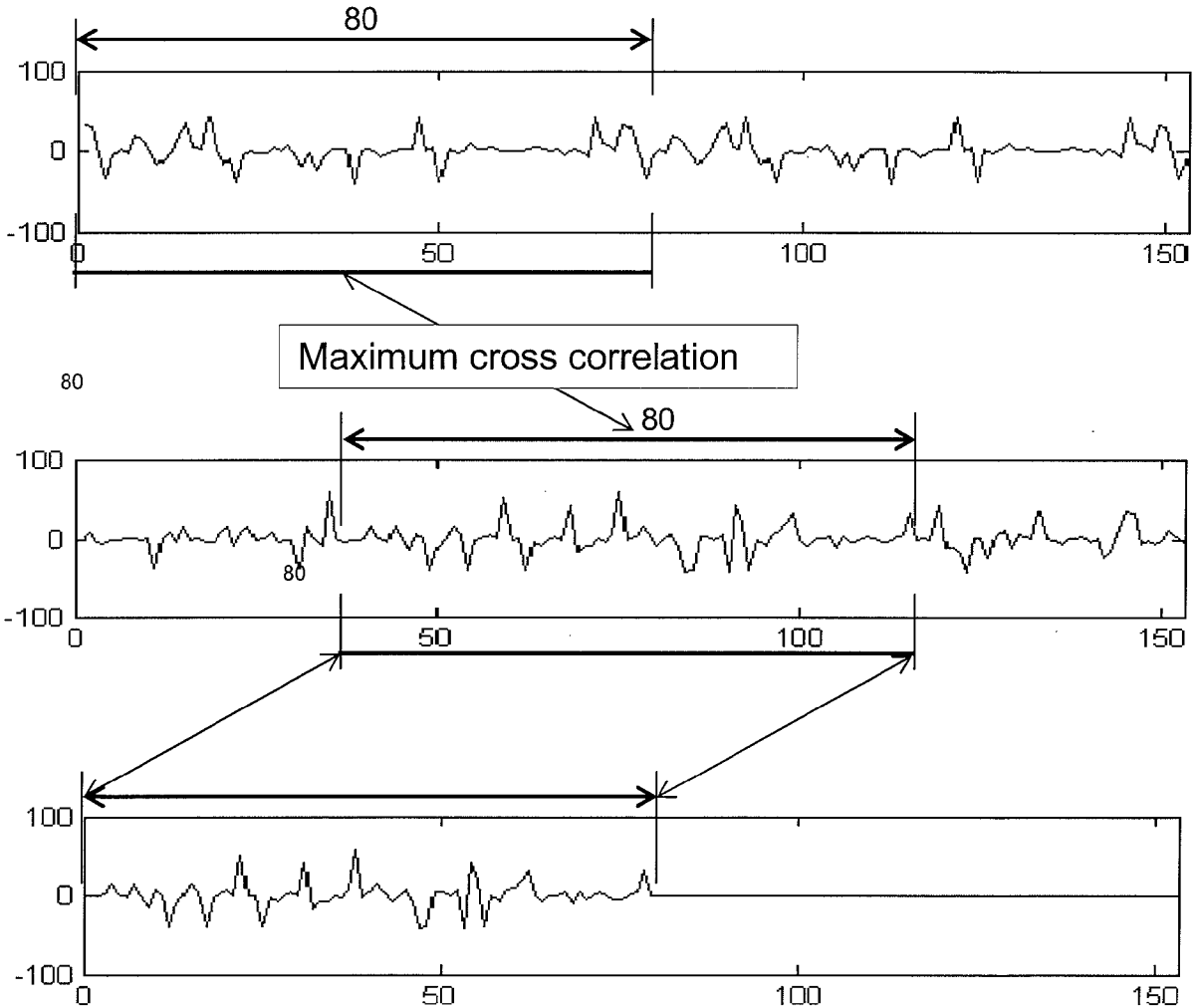
FIG. 10 is a conceptual diagram illustrating a process of generating a noise excitation signal according to an exemplary embodiment of the present invention.
Figure 11:
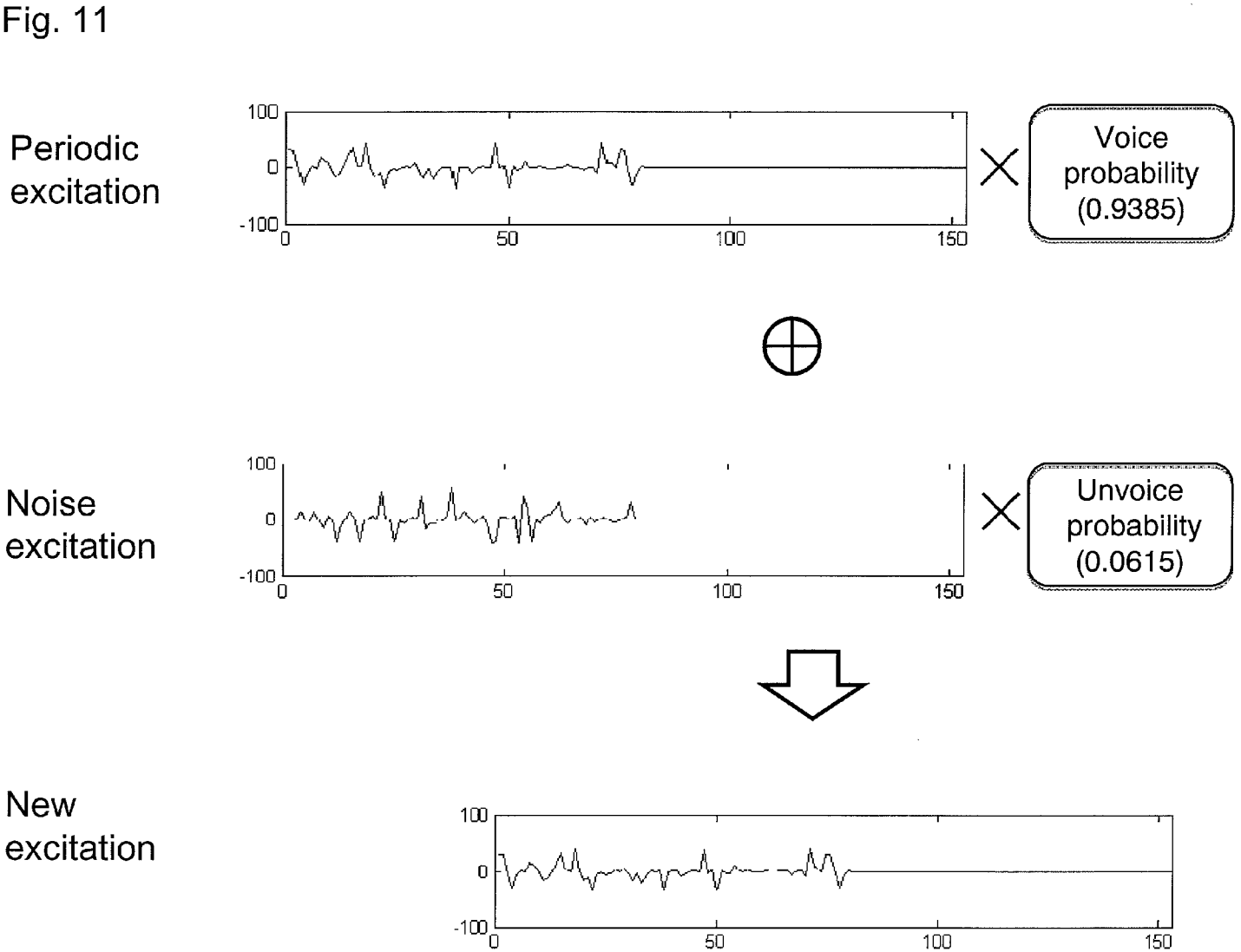
FIG. 11 is a conceptual diagram illustrating a process of generating an excitation signal for a lost frame according to an exemplary embodiment of the present invention.
Figure 12:
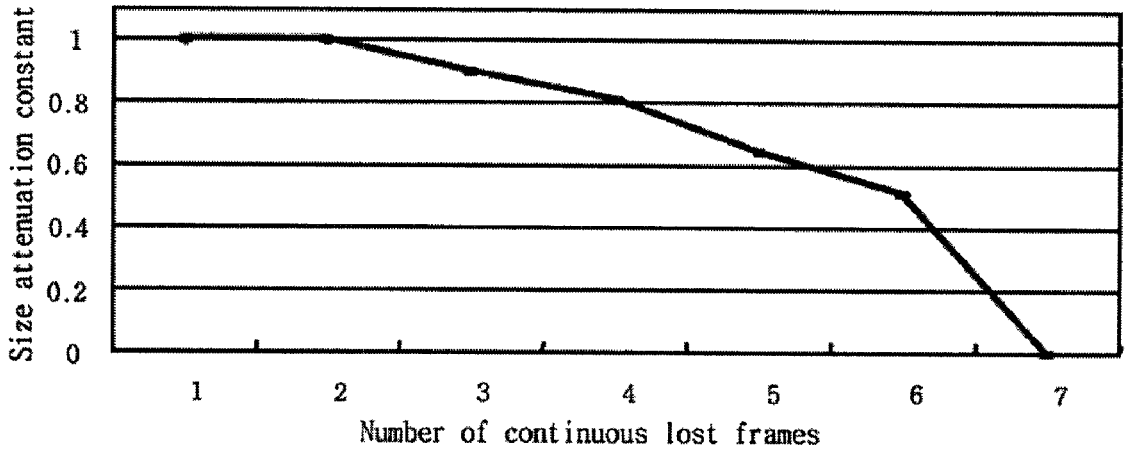
FIG. 12 is a graph illustrating an amplitude attenuation constant NS depending on a number of continuous lost frames according to an exemplary embodiment of the present invention.
Figure 13:
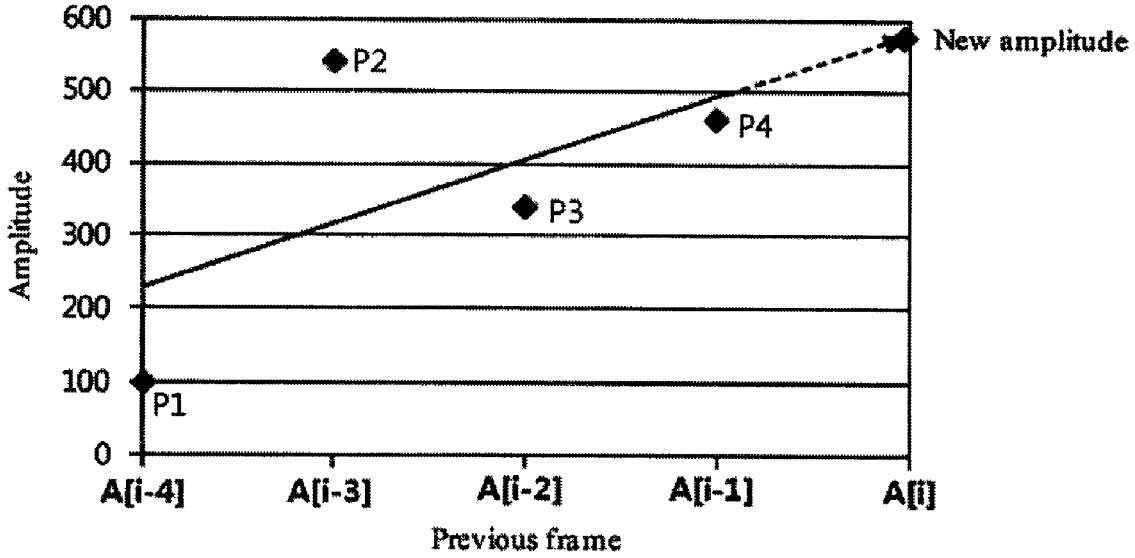
FIG. 13 is a graph showing the amplitude of an excitation signal predicted from previous frames using linear regression analysis according to an exemplary embodiment of the present invention.

FIG. 4 is a flowchart illustrating a method for concealing frame loss according to an exemplary embodiment of the present invention. FIG. 5 is a graph showing an excitation signal and a pitch for the most recent frame recovered without loss for use in calculating a voicing factor according to an exemplary embodiment of the present invention, FIG. 6 is a conceptual diagram for explaining classification of signals depending on a voicing probability, FIG. 7 is a conceptual diagram for explaining a process of generating a periodic pitch excitation signal, FIGS. 8 and 9 are conceptual diagrams for explaining a process of generating a random excitation signal, and FIG. 10 is a conceptual diagram illustrating a process of generating a noise excitation signal according to an exemplary embodiment of the present invention. FIG. 11 is a conceptual diagram illustrating a process of generating an excitation signal for a lost frame according to an exemplary embodiment of the present invention. FIG. 12 is a graph illustrating an amplitude attenuation constant NS depending on a number of continuous lost frames according to an exemplary embodiment of the present invention, and FIG. 13 is a graph showing the amplitude of an excitation signal predicted from previous frames using linear regression analysis according to an exemplary embodiment of the present invention.

Hereinafter, a method for concealing packet loss according to an exemplary embodiment of the present invention will be described with reference to FIGS. 4 to 13.

Referring first to FIG. 4, a frame is received (S401) and a determination is made as to whether loss of the current received frame occurs (S403). Information on the lossless frame is backed up in the frame backup unit 150.

When it is determined that the current received frame is lossless, it is decoded to recover an excitation signal and a linear prediction coefficient (S405).

When it is determined that loss of the current received frame occurs, the excitation signal and the pitch value are decoded from the recently received lossless frame to recover the lost frame (S407). In this case, each time loss of the current received frame occurs, the lost frames are counted to increment a numerical value of continuous lost frames. When frame loss does not occur, the numerical value of the continuous lost frames may be reset.

A correlation coefficient of the recovered excitation signal is calculated based on the recovered pitch (with a period T) and used to obtain a voicing probability (S409).

The voicing-probability calculator 202 may calculate the correlation coefficient of the recovered excitation signal using the excitation signal and the pitch value (with the period T) recovered from the most recent frame received without loss (the (m−1)-th frame) according to Equation 1:

$$\gamma = \frac{\left|\sum_{i=0}^{k-1} x(i)x(i+T)\right|}{\sqrt{\sum_{i=0}^{k-1} x^2(i)}\sqrt{\sum_{i=0}^{k-1} x^2(i+T)}} \quad \text{Equation 1}$$

where x(i) denotes the excitation signal for the most recent frame received and recovered without loss, T denotes the pitch period, and γ denotes the correlation coefficient. k denotes a maximum comparative excitation signal index, which may be for example 60.

The voicing-probability calculator 220 obtains a voicing factor $v_f$ using Equation 2 based on the calculated correlation coefficient, and obtains a voicing probability $P_v$ of the recovered excitation signal using Equation 3:

$$v_f = \sqrt{\gamma} \quad \text{Equation 2}$$

$$P_v = \begin{cases} 1, & \text{if } v_f \geq 0.7 \\ \dfrac{v_f - 0.3}{0.4}, & \text{if } 0.3 \leq v_f < 0.7 \\ 0, & \text{if } v_f < 0.3 \end{cases} \quad \text{Equation 3}$$

The speech signal may be divided into a voiced speech signal and a non-voiced speech signal. The voiced speech signal and the non-voiced speech signal may be classified based on the correlation coefficient. The voiced speech signal has a high correlation relationship with an adjacent speech signal, and the non-voiced speech signal has a low correlation relationship with an adjacent speech signal. When the correlation coefficient is nearly 1, it is said that the speech signal has a voiced speech feature, and when the correlation coefficient is nearly 0, it is said that the speech signal has a non-voiced speech feature.

The voiced speech feature and the non-voiced speech feature may be estimated by obtaining a maximum correlation coefficient based on the excitation signal and the pitch for the most recent received lossless frame.

Referring to FIG. 6 and Equation 3, when the voicing factor $v_f$ is 0.7 or greater, the voicing probability is 1, and when the voicing factor $v_f$ is less than 0.3, the voicing probability is 0 (the non-voicing probability is 1).

When continuous frame loss occurs, the previous probability calculated using the pitch value and the excitation signal for the frame most recently recovered without loss (i.e., the voicing probability calculated for the most recent lossless frame) may be used as a voicing probability for recovering an excitation signal for a second lost frame.

Referring back to FIG. 4, the excitation signal generator 210 generates the random excitation signal 215 and the pitch excitation signal A2 (S411).

The pitch excitation signal A2 may be generated as a periodic excitation signal through repetition of the pitch of the most recently received lossless frame.

The random excitation signal 215 may be generated by randomly permuting the excitation signal for the most recent frame received without loss. As shown in FIG. 8, a sample is selected from a selection range having a length in a pitch period of the excitation signal (a previous excitation signal) recovered from the most recent frame received without loss, and the selection range is shifted by one sample so that the same sample is not selected upon selecting a next sample, as shown in FIG. 9.

The excitation signal generator 210 then generates a noise excitation signal A3 (S413). In the present invention, periodicity is applied to the random excitation signal used for the fixed codebook to generate a noise excitation signal A3, based on a research result that the fixed codebook is random and affected by periodicity.

The correlation γ between the random excitation signal and the pitch excitation signal is calculated by Equation 4 in order to generate the noise excitation signal A3:

$$\gamma = \frac{\left|\sum_{i=0}^{k-1} D(i)R(i+S)\right|}{\sqrt{\sum_{i=0}^{k=1} D^2(i)}\sqrt{\sum_{i=0}^{k-1} R^2(i+S)}} \quad \text{Equation 4}$$

where D(n) denotes the pitch excitation signal, R(n) denotes the random excitation signal, S denotes a shift index of the random excitation signal, and γ denotes the correlation coefficient. k denotes a maximum comparative excitation signal index that is equal to 80 when a length of one data frame is 10 ms at a sampling frequency of 8 kHz in the present exemplary embodiment. The shift index S of the random excitation signal ranges from 0 to 73 in the present exemplary embodiment.

The correlation γ between the pitch excitation signal and the random excitation signal increases the shift index S of the random excitation signal. The correlation γ is calculated continuously using Equation 4. As shown in FIG. 10, the random excitation signal having the highest correlation with the pitch excitation signal when the index S increases is used as the noise excitation signal A3.

The lost frame excitation signal generator 240 recovers the excitation signal for the lost frame using the produced voicing probability, the pitch excitation signal A2, and the noise excitation signal A3 (S415).

In recovering the excitation signal for the lost frame, the voicing probability PV is applied as a weight to the pitch excitation signal A2, and the non-voicing probability defined as $(1-P_v)$ is applied as a weight to the noise excitation signal A3.

The pitch excitation signal A2 and the noise excitation signal A3 to which the respective weights have been applied are summed according to Equation 5, resulting in an (new) excitation signal for the lost frame (see FIG. 11):

$$e(n)=P_v \times e_T(n)+(1-P_v)\times e_r(n),\ n=0,\ldots,N-1 \quad \text{Equation 5}$$

where N denotes a sample number of the frame, $e_T(n)$ denotes the generated pitch excitation signal, $e_r(n)$ denotes the noise excitation signal, and e(n) denotes the recovered excitation signal for the lost frame.

Meanwhile, when continuous frame loss occurs, the pitch excitation signal and the noise excitation signal may be generated using the previously recovered excitation signal (i.e., an excitation signal for an immediately preceding lost frame) and the pitch value recovered without loss. In this case, the pitch value recovered from the most recent lossless frame may be used as the pitch value recovered without loss.

When the excitation signal for the lost frame has been recovered as described above, the linear prediction coefficient recovering unit 250 recovers the linear prediction coefficient for the lost frames using the linear prediction coefficient for the most recent frame recovered without loss (S417).

Specifically, the linear prediction coefficient for the most recent frame recovered without loss is used to recover the linear prediction coefficient for the lost frames according to Equation 6:

$$a_i^{(m)}=0.99^i \times a_i^{(m-1)},\ i=1,\ldots,10 \quad \text{Equation 6}$$

where m denotes a current frame number, and $a_i^{(m)}$ denotes the i-th linear prediction coefficient in the m-th frame. Here, it is assumed that the (m−1)-th frame is lossless.

The formant bandwidth of the synthesis filter 320 is extended by reducing the amplitude of the linear prediction coefficient according to Equation 6, such that a spectrum of a frequency domain is smoothed.

Meanwhile, the linear prediction coefficient for the immediately preceding recovered lost frame (i.e., the first lost frame) may be used for the continuous lost frame (e.g., the second lost frame).

Referring back to FIG. 4, the attenuation constant generator 230 obtains a third, new attenuation constant AS using the first attenuation constant (NS) obtained based on the number of continuously lost frames and the second attenuation constant (PS) predicted in consideration of the change in amplitude of previously received frames, to adjust the amplitude of the excitation signal for the lost frame (S419).

Specifically, the first attenuation constant NS is obtained depending on the number of continuously lost frames by setting the first attenuation constant NS to 1 for the first frame loss, 1 for the second frame loss, and 0.9 for the third frame loss, as shown in FIG. 12, depending on the number of continuously lost frames.

The second predicted attenuation constant PS is obtained by considering a change in the amplitude of the excitation signals for previously received frames. Specifically, an average of the amplitude of the excitation signals for the lost previous frames is obtained using Equation 7 in order to predict the amplitude of the recovered excitation signal in consideration of change in amplitude of excitation signals for previously received frames:

$$A[i-k] = \frac{\sum_{j=0}^{N-1} |S_i[i]|}{N} \quad \text{Equation 7}$$

where N denotes a number of samples in one frame, S(n) denotes the excitation signal, i denotes an index of the lost frame, which is an index of a frame following the (i−k)-th lost frame. In the present exemplary embodiment, since signal amplitude information for four frames following the lost frame is used, k=1, 2, 3 and 4.

The average of the amplitude of the excitation signals for the previous frames is applied to the linear regression analysis (regression modeling), such that the change in the excitation signal amplitude for the previous frames can be represented by Equation 8. The predicted amplitude of the excitation signal (new amplitude) can be obtained using linear regression analysis, as shown in FIG. 13.

$$y(x)=y(x|a,b)=a+bx \quad \text{Equation 8}$$

where a and b denote coefficients of the linear regression analysis model, and x denotes the amplitude of the excitation signal for the frame following the lost frame.

The amplitude of the excitation signal for the lost frame can be predicted using Equation 8, which is obtained by modeling an average of the amplitude of the excitation signals for frames following the lost frame. The predicted amplitude of the excitation signal and the amplitude of the excitation signals for the frames following the lost frame may be applied to Equations 9 and 10 to obtain a ratio of the predicted amplitude of the excitation signals:

$$R_s = \frac{A[i]}{A[i-1]}, \quad \text{if } A[i-1] > 0 \quad \text{Equation 9}$$
$$R_s = 1 \quad \text{if } A[i-1] = 0$$

$$PS = 1.3 \quad \text{if } R_s \geq 1.3 \quad \text{Equation 10}$$
$$PS = R_s \quad \text{if } 0.7 \leq R_s < 1.3$$
$$PS = 0.7 \quad \text{if } R_s < 0.7$$

where A[i] denotes an average of the predicted amplitude of the excitation signals, A[i−1] denotes an average of the excitation signal amplitude for the frame following the lost frame, and PS denotes the second attenuation constant of the predicted amplitude of the excitation signal.

The first attenuation constant NS and the second attenuation constant PS are summed using Equation 11, resulting in the third attenuation constant AS for adjusting the amplitude of the recovered excitation signal:

$$AS = \frac{1}{2}NS + \frac{1}{2}PS \quad \text{Equation 11}$$

where NS denotes the first attenuation constant obtained according to a number of continuous frame losses, as in FIG. 12, PS denotes the second predicted attenuation constant, and AS denotes the third, new attenuation constant.

Although it is illustrated that the second attenuation constant PS is multiplied by 0.5 and the first attenuation constant NS is multiplied by 0.5 to calculate the third attenuation constant, the weights may vary within a range in which a sum of the weights for the first attenuation constant NS and the second attenuation constant PS becomes 1, and the second attenuation constant PS and the first attenuation constant NS may be multiplied by the changed weights to calculate the third attenuation constant.

The recovered excitation signal obtained by Equation 5 may be multiplied by the third, new attenuation constant to adjust the amplitude of the recovered excitation signal.

Although the process of obtaining the predicted amplitude of the excitation signal (new amplitude) using the linear regression analysis has been described, the amplitude of the excitation signal may be predicted using non-linear regression analysis.

Referring back to FIG. 4, the recovered excitation signal and the linear prediction coefficient for the lost frame are applied to the synthesis filter 320 as described above to recover and output the speech for the lost frame (S421).

In another exemplary embodiment of the present invention, the recovered excitation signal obtained by Equation 5 may be directly multiplied by the first attenuation constant obtained based on the number of continuously lost frames to adjust the amplitude of the recovered excitation signal for the lost frame and provide the adjusted excitation signal to the synthesis filter, instead of multiplying the recovered excitation signal obtained according to Equation 5 using the random excitation signal having the highest correlation with the pitch excitation signal as the noise excitation signal, by the third produced attenuation constant.

In still another exemplary embodiment of the present invention, the pitch excitation signal A2 generated through repetition of the pitch of the most recent frame received without loss may be multiplied by the voicing probability, and the random excitation signal 215 generated by randomly permuting the excitation signal for the most recent frame received without loss may be multiplied by the non-voicing probability to generate the recover excitation signal for the lost frame, instead of applying periodicity to the random excitation signal to separately generate a noise excitation signal as described above. Then, the recovered excitation signal may be multiplied by the third attenuation constant to adjust the amplitude of the recovered excitation signal and provide the adjusted the excitation signal to the synthesis filter.

Although the method for concealing frame loss based on CELP CODEC has been illustrated, the method for concealing frame loss according to the present invention may be applied to any other speech CODECs using an excitation signal.

Figure 18:
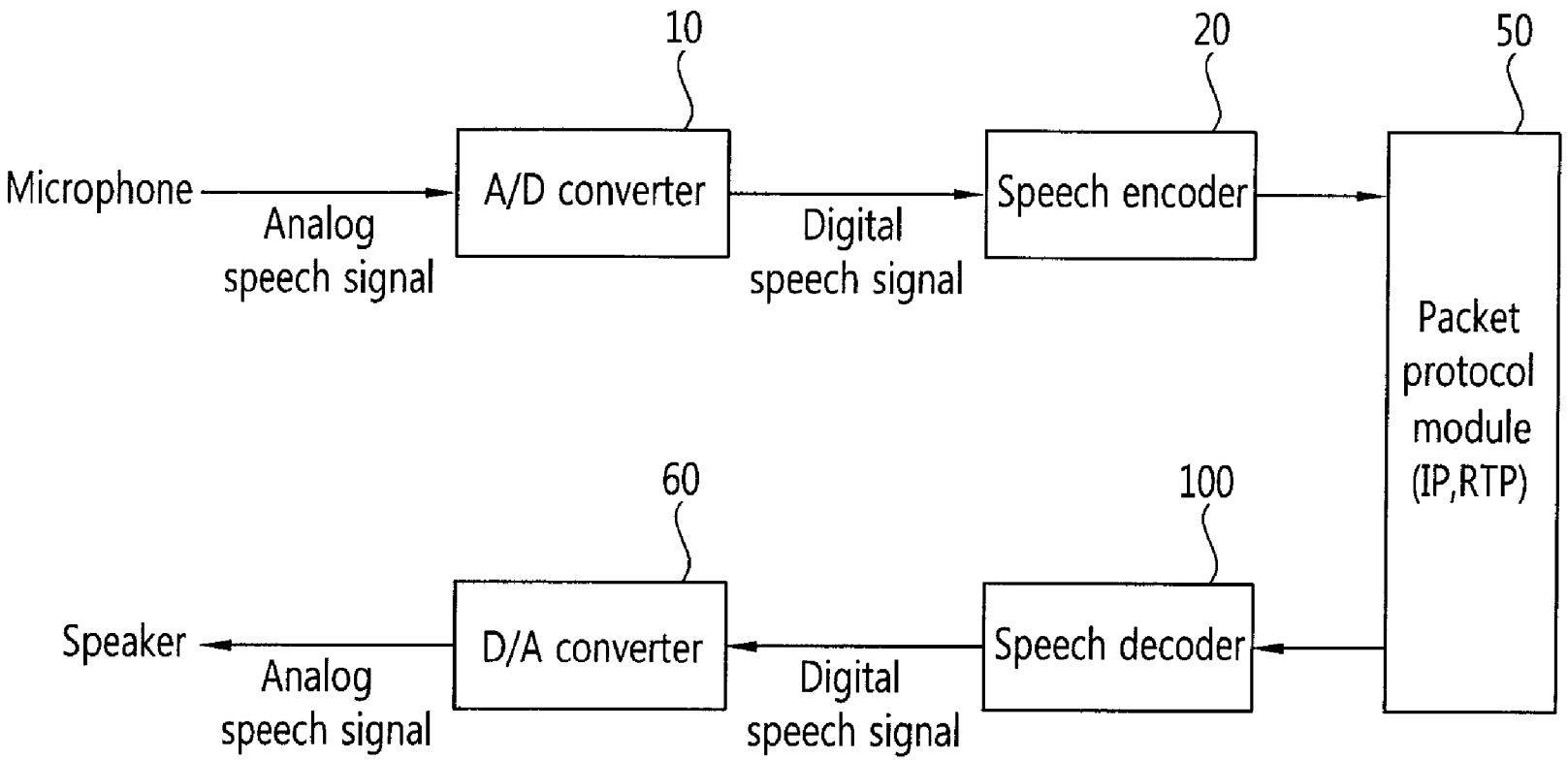
FIG. 18 is a block diagram of an apparatus for transmitting and receiving a speech signal via a packet network that performs the method for concealing frame loss according to an exemplary embodiment of the present invention.

FIG. 18 is a block diagram of an apparatus for transmitting and receiving a speech signal via a packet network that performs the method for concealing frame loss according to an exemplary embodiment of the present invention.

Referring to FIG. 18, the apparatus for transmitting and receiving a speech signal includes an analog-digital converter 10, a speech encoder 20, a packet protocol module 50, a speech decoder 100, and a digital-analog converter 60.

The analog-digital converter 10 converts an analog speech signal input via a microphone into a digital speech signal.

The speech encoder 20 compresses and encodes the digital speech signal.

The packet protocol module 50 processes the compressed and encoded digital speech signal according to Internet protocol (IP) to convert the digital speech signal into a format suitable for transmission via the packet network, and outputs a speech packet.

The packet protocol module 50 receives a speech packet transmitted via the packet network, unpacks the speech packet to convert it into speech data on a frame-by-frame basis, and outputs the speech data.

The speech decoder 100 recovers the speech signal from the speech data on a frame-by-frame basis received from the packet protocol module 50 using the method for concealing frame loss according to an exemplary embodiment of the present invention. Since the speech decoder 100 has the same configuration as the speech decoder described with reference to FIGS. 2 and 3, it will not be described.

The digital-analog converter 60 converts digital speech data recovered as a speech signal into an analog speech signal, which is output to a speaker.

The apparatus for transmitting and receiving a speech signal that performs the method for concealing frame loss according to an exemplary embodiment of the present invention may be applied to VoIP terminals and even to VoWiFi terminals.

In order to evaluate the performance of the method for concealing frame loss according to an exemplary embodiment of the present invention, 48 Korean men's speeches and 48 Korean women's speeches, each having a length of 8 seconds, were selected as test data from a NTT-AT database [NTT-AT, Multi-lingual speech database for telephonemetry, 1994]. Modified IRS filtering is applied to each stored speech signal at 16 kHz, which was then down-sampled to 8 kHz and used as an input signal of G.729 [ITU-T Recommendation G.729, Coding of speech at 8 kbits/s using conjugate-structure code-excited linear prediction (CS-ACELP), February 1996].

A Gilbert-Elliot model defined in ITU-T standard G.191 [ITU-T Recommendation G.191, Software Tools for Speech and Audio Coding Standardization, November, 2000] was used for frame loss circumference. Using the frame loss model, loss patterns were generated at frame loss rates of 3% and 5%, and manually modified so that the numbers of continuously lost frames were 2, 3, 4, 5, and 6. PESQ [ITU-T Recommendation P.862, Perceptual Evaluation of Speech Quality (PESQ), An Objective Method for End-to-End Speech Quality Assessment of Narrowband Telephone Networks and Speech Coders, February, 2001], which is an objective evaluation method for speech quality provided by the ITU-T, and subjective speech quality evaluation were used as performance evaluation methods in order to compare the performance of a standard method for concealing frame loss implemented on G.729 (hereinafter, referred to as the G.729 method), a method for concealing frame loss based on a voicing probability, and a method for concealing frame loss based on a voicing probability according to the present invention.

Figure 14:
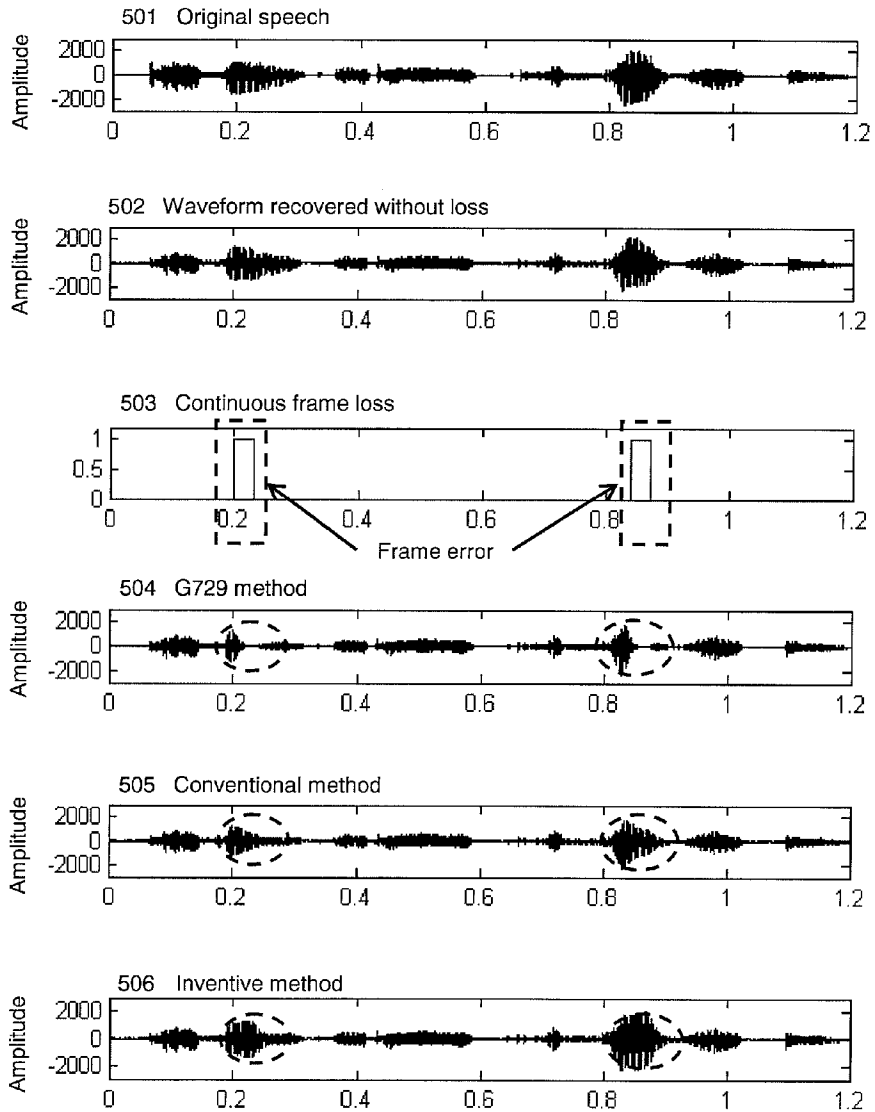
FIG. 14 is a graph showing a comparison of recovered waveforms among a conventional method for concealing frame loss, a G.729 method for concealing frame loss, and the method for concealing frame loss according to the present invention.

FIG. 14 is a graph showing a comparison of recovered waveforms among a conventional method for concealing frame loss, a G.729 method for concealing frame loss, and the method for concealing frame loss according to the present invention.

Referring to FIG. 14, the experiment showed that a waveform indicated by a graph 502 was obtained when a bit stream produced by encoding original speech transmitted from a transmitting stage (indicated by a graph 501) with G.729 was decoded without loss. When continuous frame loss occurred as indicated by graph 503, the frame was recovered into a waveform as indicated by graph 504 using the G.729 method and into a waveform as indicated by graph 505 using the conventional method. Here, the conventional method for concealing continuous frame loss was disclosed in "G.729 Frame Loss Concealing Algorithm that is Robust to Continuous Frame Loss", May 19, 2007 (The Korean Society of Phonetic Sciences and Speech Technology, Semiannual, Cho Chung-sang, Lee Young-Han, and Kim Heung-Kuk).

The frame was recovered into a waveform as indicated by graph 506 by using the method for concealing frame loss according to the present invention as shown in FIG. 4.

It can be seen that graphs 504 and 505 of the G.729 method and the conventional method are very different from graph 502 showing a waveform recovered without loss when continuous frame loss occurred, as indicated by dotted portions of graphs 504 and 505. Meanwhile the, inventive method is capable of recovering speech similar to the original speech, even when continuous frame loss occurs, as indicated by a dotted portion of graph 506.

The G.729 method, the conventional method, and the inventive method were compared through PESQ.

FIG. 15 is a table showing PESQ measurement results for 2, 3, 4, 5, and 6 continuously lost frames in order to evaluate the performance of the inventive method shown in FIG. 4 when continuous frame loss occurs.

As shown in FIG. 15, when continuous frame loss rate (burstiness, $\gamma$) is 0, i.e., when a continuous loss probability in a Gilbert-Elliot model is lowest, the methods exhibited similar performances at frame loss rates of 3% and 5%. However, in the case of continuous frame loss, when $\gamma$ is equal to 1, i.e., the continuous loss probability in the Gilbert-Elliot model is highest, the conventional method exhibited a Mean Opinion Score (MOS) improvement of 0.02 to 0.16 over the G.729 method, depending on the number of lost frames. The inventive method exhibited an MOS value improvement of 0.04 to 0.20 over the G.729 method depending on the number of lost frames.

A preference experiment was performed on eight persons for subjective evaluation of speech quality with respect to the inventive method. In the experiment, the Gilbert-Elliot model was used as a packet loss simulation model, in which for continuous frame loss, $\gamma$ as a Gilbert-Elliot model parameter was 0 and 1. In this case, $\gamma$ being equal to 1 indicates that the probability of continuous packet loss was highest at a given packet loss rate.

FIG. 16 is a table showing subjective evaluation results for speech quality in the conventional method for concealing continuous frame loss and the G.729 method for concealing frame loss.

Referring to FIG. 16, the conventional method for concealing continuous frame loss exhibited a relatively 20.5% higher preference than the G.729 method, in which the preference of the conventional method was 30.25% on average and the preference of the G.729 method was 9.75%.

FIG. 17 is a table showing subjective speech quality evaluation results in the enhanced method for concealing frame loss according to the present invention and the G.729 method for concealing frame loss.

Referring to FIG. 17, the inventive method exhibited a relatively 46.35% higher preference over the G.729 method, in which the preference of the inventive method was 51.04% on average and the preference of the G.729 method was 4.69%. The inventive method achieved preference improvement of 16.10%.

As described above, according to a method for concealing packet loss in a speech decoder of the present invention, when loss of a current received frame occurs, a random excitation signal having the highest correlation with a periodic excitation signal (i.e., a pitch excitation signal) decoded from a previous frame received without loss is used as a noise excitation signal to recover an excitation signal of a current lost frame, based on the fact that a fixed codebook used as an excitation signal generating element has a random characteristic and is affected by a periodic component.

Furthermore, in the method for concealing packet loss in a speech decoder of the present invention, a third, new attenuation constant (AS) can be obtained by summing a first attenuation constant (NS) obtained based on the number of continuously lost frames and a second attenuation constant (PS) predicted in consideration of change in amplitude of previously received frames to adjust the amplitude of the recovered excitation signal for the current lost frame.

Thus, in an environment in which continuous frame loss occurs, e.g., in IP networks such as VoIP and Voice Over Wireless Fidelity (VoWiFi) networks in which packet loss frequently occurs, speech quality degradation caused by packet loss can be reduced more than by conventional methods for concealing frame loss, thereby enhancing speech recovery performance and providing enhanced communication quality.

While exemplary embodiments of the present invention have been shown and described, it will be appreciated by those skilled in the art that various changes can be made to the described exemplary embodiments without departing from the spirit and scope of the invention defined by the claims and their equivalents.

What is claimed is:

1. A method for concealing frame loss in a speech decoder, the method comprising:

when loss of a current received frame occurs, calculating a voicing probability using an excitation signal and a pitch value decoded from a previous frame received without loss;

generating a noise excitation signal using a random excitation signal and a pitch excitation signal generated from the excitation signal decoded from the previous frame received without loss; and applying a weight determined by the voicing probability to the pitch excitation signal and the noise excitation signal to recover an excitation signal for the current lost frame.

2. The method according to claim 1, further comprising: obtaining a correlation between the random excitation signal and the pitch excitation signal and using a random excitation signal having the highest correlation with the pitch excitation signal as the noise excitation signal.

3. The method according to claim 1, wherein the previous frame received without loss is the most recently received lossless frame.

4. The method according to claim 1, wherein the calculating of the voicing probability comprises:

calculating a first correlation coefficient of the excitation signal decoded from the previous frame received without loss, based on the pitch value, from the excitation signal and the pitch value decoded from the previous frame received without loss;

calculating a voicing factor using the first calculated correlation coefficient; and calculating the voicing probability using the calculated voicing factor.

5. The method according to claim 1, wherein the random excitation signal is generated by randomly permuting the excitation signal decoded from the previous frame received without loss, and the pitch excitation signal is a periodic excitation signal generated through repetition of the pitch decoded from the previous frame received without loss.

6. The method according to claim 1, wherein the applying of the weight determined by the voicing probability to the pitch excitation signal and the noise excitation signal to recover an excitation signal for the current lost frame comprises: applying the voicing probability as a weight to the pitch excitation signal, applying a non-voicing probability determined by the voicing probability as a weight to the noise excitation signal, and summing the resultant signals to recover the excitation signal for the current lost frame.

7. The method according to claim 1, further comprising: reducing a linear prediction coefficient of the previous frame received without loss to recover a linear prediction coefficient for the current lost frame.

8. The method according to claim 7, further comprising: multiplying a first attenuation constant (NS) obtained based on the number of continuously lost frames by a first weight, multiplying a second attenuation constant (PS) predicted in consideration of change in amplitude of previously received frames by a second weight, and multiplying a third attenuation constant (AS) calculated by summing the first attenuation constant (NS) multiplied by the first weight and the second attenuation constant (PS) multiplied by the second weight, by the recovered excitation signal for the current lost frame, to adjust the amplitude of the recovered excitation signal for the current lost frame.

9. The method according to claim 8, wherein the second attenuation constant (PS) is obtained by applying linear regression analysis to an average of the excitation signals for the previously received frames.

10. The method according to claim 8, further comprising: applying the amplitude-adjusted recovered excitation signal and the recovered linear prediction coefficient for the current lost frame to a synthesis filter to recover and output speech for the current lost frame.

11. The method according to claim 1, further comprising: multiplying the recovered excitation signal for the current lost frame by the first attenuation constant (NS) obtained based on the number of continuously lost frames to adjust the amplitude of the recovered excitation signal for the current lost frame.

12. The method according to claim 1, further comprising: when loss of the current received frame does not occur, decoding the current frame to recover the excitation signal and linear prediction coefficient.

13. The method according to claim 1, wherein when continuous frame loss occurs, a voicing probability calculated using the pitch value and the excitation signal decoded from the most recent frame received without loss is used as a voicing probability for recovering an excitation signal for a second lost frame.

14. A method for concealing frame loss in a speech decoder, the method comprising:

when loss of a current received frame occurs, calculating a voicing probability using an excitation signal and a pitch value decoded from a previous frame received without loss;

generating a random excitation signal and a pitch excitation signal from the excitation signal decoded from the previous frame received without loss;

applying a weight determined by the voicing probability to the pitch excitation signal and the random excitation signal to recover an excitation signal for the current lost frame; and adjusting the amplitude of the recovered excitation signal for the current lost frame using a third attenuation constant calculated based on a first attenuation constant obtained based on the number of continuously lost frames and a second attenuation constant predicted in consideration of change in amplitude of previously received frames.

15. The method of claim 14, wherein the adjusting of the amplitude of the recovered excitation signal for the current lost frame comprises:

multiplying the first attenuation constant obtained based on the number of continuously lost frames by the first weight, multiplying the second attenuation constant predicted in consideration of the change in amplitude of previously received frames with the second weight, and multiplying the recovered excitation signal for the current lost frame by the third attenuation constant calculated by summing the first attenuation constant multiplied by the first weight and the second attenuation constant multiplied by the second weight to adjust the amplitude of the recovered excitation signal for the current lost frame.

16. The method according to claim 15, wherein the second attenuation constant is obtained by applying linear regression analysis to an average of the excitation signals for previously received frames.

17. The method of claim 14, wherein the calculating of the voicing probability comprises:

calculating a first correlation coefficient of the excitation signal decoded from the previous frame received without loss, based on the pitch value, from the excitation signal and the pitch value decoded from the previous frame received without loss;

calculating a voicing factor using the first calculated correlation coefficient; and calculating the voicing probability using the calculated voicing factor.

18. The method of claim 14, wherein the applying of the weight determined by the voicing probability to the pitch excitation signal and the random excitation signal to recover an excitation signal for the current lost frame comprises: applying the voicing probability as a weight to the pitch excitation signal, applying a non-voicing probability determined by the voicing probability as a weight to the noise excitation signal, and summing the resultant signals to recover the excitation signal for the current lost frame.

19. An apparatus for concealing frame loss in a received speech signal, the apparatus comprising:

a frame loss concealing unit configured to, when loss of a current received frame occurs, calculate a voicing probability using an excitation signal and a pitch value decoded from a previous frame received without loss, generate a noise excitation signal using a random excitation signal and a pitch excitation signal generated from the excitation signal decoded from the previous frame received without loss, and apply a weight determined with the voicing probability to the pitch excitation signal and the noise excitation signal to recover an excitation signal for the current lost frame.

20. The apparatus according to claim 19, further comprising a frame loss determiner configured to determine whether loss of the current received frame occurs.

21. The apparatus according to claim 19, further comprising a frame backup unit configured to store the excitation signal and the pitch value decoded from the previous frame received without loss.

22. The apparatus according to claim 19, wherein a correlation between the random excitation signal and the pitch excitation signal is obtained and a random excitation signal having the highest correlation with the pitch excitation signal is used as the noise excitation signal.

23. The apparatus according to claim 19, wherein the frame loss concealing unit applies the voicing probability as a weight to the pitch excitation signal, applies a non-voicing probability determined by the voicing probability as a weight to the noise excitation signal, and sums the resultant signals to recover the excitation signal for the current lost frame.

24. The apparatus according to claim 19, wherein the frame loss concealing unit further comprises a linear prediction coefficient recovering unit for reducing a linear prediction coefficient of the previous frame received without loss and recovering a linear prediction coefficient for the current lost frame.

25. The apparatus according to claim 19, wherein the frame loss concealing unit multiplies a first attenuation constant (NS) obtained based on the number of continuously lost frames by the first weight, multiplies a second attenuation constant (PS) predicted in consideration of the change in amplitude of previously received frames by the second weight, and multiplies the recovered excitation signal for the current lost frame by a third attenuation constant (AS) calculated by summing the first attenuation constant multiplied by the first weight NS and the second attenuation constant multiplied by the second weight PS to adjust the amplitude of the recovered excitation signal for the current lost frame.

26. An apparatus for concealing frame loss in a received speech signal, the apparatus comprising:

a frame loss concealing unit configured to, when loss of a current received frame occurs, calculate a voicing probability using an excitation signal and a pitch value decoded from a previous frame received without loss, generate a noise excitation signal using a random excitation signal and a pitch excitation signal generated from the excitation signal decoded from the previous frame received without loss, and apply a weight determined by the voicing probability to the pitch excitation signal and the noise excitation signal to recover an excitation signal for the current lost frame.

27. The apparatus according to claim 26, further comprising a frame backup unit for storing the excitation signal and the pitch value decoded from the previous frame received without loss.

28. An apparatus for transmitting and receiving a speech signal via a packet network, the apparatus comprising:

an analog-digital converter configured to convert an input analog speech signal into a digital speech signal;

a speech encoder configured to compress and encode the digital speech signal;

a packet protocol module configured to convert the compressed and encoded digital speech signal according to Internet protocol to produce a speech packet, unpacking a speech packet received from the packet network, and converting the speech packet into speech data on a frame-by-frame basis;

a speech decoder configured to recover the speech signal from the speech data on a frame-by-frame basis; and a digital-analog converter configured to convert the recovered speech signal into an analog speech signal, wherein the speech decoder comprises:

a frame backup unit configured to store an excitation signal and a pitch value decoded from a previous frame received without loss; and a frame loss concealing unit configured to, when loss of a current received frame occurs, calculate a voicing probability using the excitation signal and the pitch value decoded from the previous frame received without loss, generate a noise excitation signal using a random excitation signal and a pitch excitation signal produced from the excitation signal decoded from the previous frame received without loss, and apply a weight determined by the voicing probability to the pitch excitation signal and the noise excitation signal to recover an excitation signal for the current lost frame.

29. The apparatus according to claim 28, wherein the frame loss concealing unit obtains a correlation between the random excitation signal and the pitch excitation signal and uses a random excitation signal having the highest correlation with the pitch excitation signal as the noise excitation signal.

* * * * *